US005484132A

United States Patent [19]

George et al.

[11] Patent Number: 5,484,132

[45] Date of Patent: Jan. 16, 1996

[54] REMOVABLE PITON CLIMBING AID AND METHOD OF USING

[76] Inventors: Philip B. George, 2025 W. Broad St.; Gregory T. Horwath, 2071 Kenmore Ave., both of Bethlehem, Pa. 18018

[21] Appl. No.: 385,275

[22] Filed: Feb. 8, 1995

[51] Int. Cl.[6] ..... A63B 29/02

[52] U.S. Cl. ..... 248/231.9; 248/925

[58] Field of Search ..... 182/3, 5, 90; 248/925, 248/231.9

[56] References Cited

U.S. PATENT DOCUMENTS 4,184,657 1/1980 Jardine ..... 248/925
4,572,464 2/1986 Phillips ..... 248/925
4,643,378 2/1987 Guthrie ..... 248/231.9
4,715,568 12/1987 Best ..... 249/925
4,834,327 5/1989 Byrne ..... 248/925
4,869,342 9/1989 Borst ..... 187/90

*Primary Examiner*—Alvin C. Chin-Shue
*Attorney, Agent, or Firm*—Charles A. Wilkinson

[57] ABSTRACT

An expansible head safety climbing chock has a three-part expansible head with an arcuate outer circumference and teeth extending around the circumference of both the wedge-type expansible head pieces and the inner end of a rigid body through which the safety rope or cable passes to the largest head piece. The expansible head safety chock is designed to be used in drilled holes in rock faces from which it is easily removed during non-use for aesthetic and safety reasons.

14 Claims, 3 Drawing Sheets

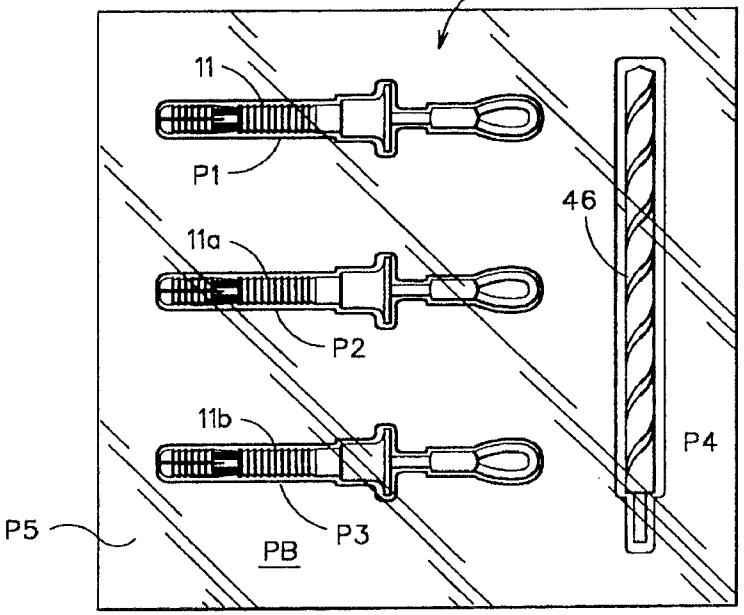
Fig. 9
Fig. 7
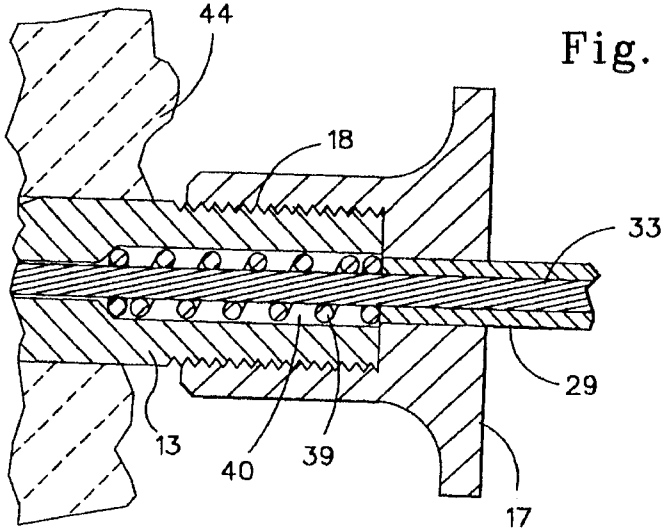
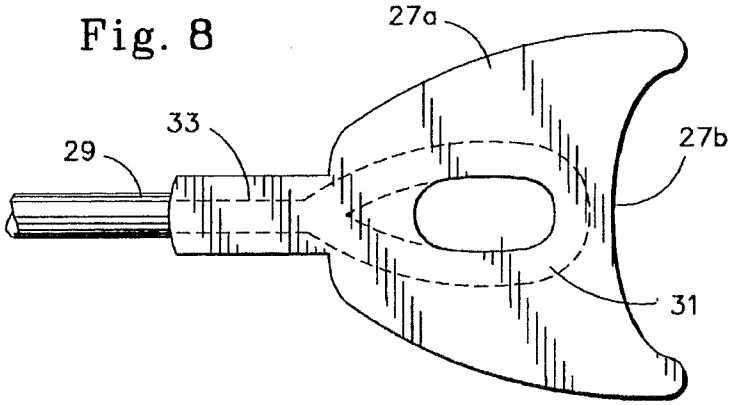
Fig. 8

REMOVABLE PITON CLIMBING AID AND METHOD OF USING

BACKGROUND OF THE INVENTION

1. Field of the Invention

This invention relates to climbing aids, particularly for rock climbing and mountain climbing. More particularly still, the present invention relates to adjustable pitons or climbing chocks having adjustable wedge-type expansible heads that can be inserted into a prepared or otherwise suitable orifice in a rock face to secure a climber against falling, but which can then be easily removed when no longer required and used again in a different suitable orifice. Use of the invention avoids leaving disfiguring pitons or chocks in a rock face where they may corrode, causing unsightly conditions plus possible serious deterioration of the piton itself over a period of time, rendering it unreliable or dangerous to use.

2. Description of the Prior Art

Sport-type mountain climbing, and particularly rock climbing, where the climber attempts to climb relatively sheer rock faces by different routes and techniques, often in an expedition or climbing party lasting only a day, or even less than a day, has burgeoned in recent years to the extent that it is sometimes difficult to even gain access to a desired rock face on a desired day.

Rock climbers rely on the use of safety or climbing ropes removably secured to a face at points selected by the climber or dictated by technique. The ropes have in the past been customarily secured to a rock face by so-called pitons and/or rock bolts which are driven into the rock face, either into preexisting cracks or the like or, in more recent years, into especially prepared openings or orifices made in the rock face by various techniques or tools. The safety ropes are then attached to such pitons and rock bolts in order to belay the climber or climbers against sudden falls or sometimes to aid such climbers in movement from place to place upon the rock face.

The traditional use of steel pitons has the serious disadvantage of leaving such pitons in the crack or other opening once placed, where they inevitably corrode, staining the surrounding rocks, with resulting serious aesthetic problems and causing serious criticism of climbers by other users of the mountains. Environmentalists and conservationists are invariably offended by the sight of multiple pitons and rock bolts, or expansion bolts, used for belaying the ropes of climbers. There are said to be as many as 7,000 fixed anchors, including pitons and expansion or rock bolts, in California's Yosemite and as many as 5,000 in California's Joshua Tree Park alone. These so-called fixed anchors are not only often offensive in themselves to nature and wilderness lovers because they remind one of the intrusion of human technology into wilderness or scenic areas, but, as noted above, their corrosion may leave large stains on the rocks, considerably deteriorating the aesthetic or scenic values for all observers and substantially impossible to remove from the rock face itself.

In recent years there has been an increasing demand by non-climbers that climbers be banned from public rock faces or at least stringently restricted with respect to where and how they can climb. Such restrictions are dictated not so much by safety considerations, but by aesthetic and environmental considerations. Laws have been proposed and regulations by both federal and state park authorities have been proposed and sometimes implemented to regulate and at times ban completely climbers on park lands.

In an attempt to decrease the degradation or outright destruction of the environment by the use of pitons and expansible or other rock bolts in rock faces, environmentally attuned climbers have in more recent years introduced the use of removable and reusable climbing aids in order to make so-called "clean climbs". Most of these devices have involved the use of expansible cam-type chocks in cracks and other openings in rock faces. Exemplary of this type of device is the so-called "Friend" climbing aid, a rotatable cam-type chock described in U.S. Pat. No. 4,184,657. This patented chock is often usable only in fairly large cracks. Another type of device more recently introduced is the flexible expansible head-type device described in U.S. Pat. No. 4,572,464. This device uses two dovetailed wedge-type heads attached to the ends of flexible wire strands which are used to facilitate insertion of such wedge-type heads into cracks and the like. While these devices have proved effective within their intended scope of use, they have not completely solved the above referred to environmental and aesthetic problems and, in fact, have at times exhibited poor attachment to the rock faces or have been difficult to remove, even though removal is supposed to be their principal advantage. Several other similar devices have been designed to remedy the basic disadvantages of the original device, disclosed in the '464 patent. For example, improvements are disclosed in U.S. Pat. Nos. 4,643,378, 4,715,568 and 4,834,327, which improved devices have each added to the flexibility of the basic device, particularly for use in cracks and the like. However, the use of such improved devices has also sometimes been less than satisfactory.

In particular, there has been a need for a removable piton or rock bolt-type device which can always gain a good grip within an orifice and can always be relatively easily removed so that it is not left on the rock face to corrode. There has also been a need for a removable piton that can be effectively used in prepared orifices which have a minimal environmental or aesthetic impact.

OBJECTS OF THE INVENTION

It is an object of this invention, therefore, to provide an improved removable piton particularly adapted for quick, convenient use in a prepared orifice in a rock face.

It is a further object of the present invention to provide a removable piton having a very close contact with the sides of a prepared orifice on essentially all sides of the piton providing superior holding power.

It is a still further object of the invention to provide an adjustable chock having a plurality of sliding wedge-shaped head pieces arranged and constructed to contact walls of a prepared orifice at a plurality of circumferential points.

It is a still further object of the invention to provide a removable chock having a simple foolproof design.

It is a still further object of the invention to provide an adjustable chock which is easily insertable into a prepared orifice, will securely grasp the sides of said orifice and is light and inexpensive.

It is a still further object of the invention to provide an adjustable safety chock having a rigid body portion which will be effective to aid in supporting a climber's weight.

It is a still further object of the invention to provide a design for an expansible safety chock which is not easily jammed by the entrance of small particulates into the mechanical components.

It is a still further object of the invention to provide an adjustable safety chock having a rigid body portion to which access can be gained to clean out rock dust from the interior to prevent clogging and interference with the operation of said chock.

It is a still further object of the invention to provide an adjustable safety chock in which the movable portions have an open structure to guard against blocking or binding as the result of particulates entering into the movable portions.

It is a still further object of the invention to provide an adjustable safety chock having a rigid body portion which is itself effective in aiding in supporting a climber's weight in combination with an expansible feature to secure the chock in an artificially formed rock orifice.

It is a still further object of the invention to provide an adjustable safety chock having a rigid body portion with an internal configuration that will not damage a wire cable passing through said rigid body portion.

Other objects and advantages of the invention will become apparent upon consideration of the appended drawings taken in conjunction with the description and explanation set forth herein below.

BRIEF DESCRIPTION OF THE INVENTION

The present invention provides a light, convenient, removable, expansible safety chock for use in belaying climbers on rock faces as well as for other similar technical climbing. The invention provides a superior anchor for use on a rock face or other climbing location and includes a multi-unit circular head quickly and conveniently inserted by hand into a prepared orifice in the rock face. Separate head pieces forming the circular head, including a principal head piece and two subsidiary or secondary head pieces, are each attached to or secured to cable sections attached to or passing through a body section. The principal head piece is secured to a principal cable section which passes through the body section and is used in the formation of a loop to which, or through which, safety ropes may be tied. Preferably such loop is passed about a stretching or forming yoke. The body portion is directly attached at one end to two secondary wire cables to the other end of which are secured the two smaller cooperating head pieces. The safety chock of the invention is formed with an open construction of the expansible head portion to avoid clogging and is openable to allow cleaning or blowing out of the body portion. The expansible safety chock is designed to be used within drilled orifices artificially drilled into rock faces and to have a very similar opening size with respect to the orifice size. Such safety chock is preferably provided in a package together with a drill size adapted for use with the particular expansible chock or chocks which are preferably provided in several sizes to allow for orifices which may be both accurately drilled and less accurately drilled.

BRIEF DESCRIPTION OF THE DRAWINGS

FIG. 7 is an enlarged side view of an embodiment of the invention in which the head of the chock is threaded onto the body portion for ease of removal.

FIG. 8 is a side view of an improved loop clamp or fitting for the chock of the invention incorporating a shape allowing convenient forward hand contact.

FIG. 9 is a plan view of a convenient sales package for a matched set of the safety chocks of the invention with a rock drill bit matching the sizes of the safety chocks for use with such safety chocks.

DESCRIPTION OF THE PREFERRED EMBODIMENTS

Figure 2:
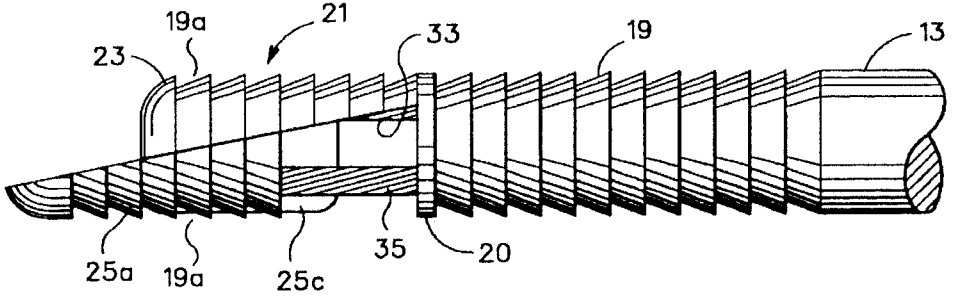
FIG. 2 is a somewhat enlarged side view of the expansible head portion of the adjustable or expansible head safety chock shown in FIG. 1.

With the "explosion" of popularity of rock climbing during the last few years, the long continued and persistent problem of defacing of popular rock faces has come more and more to the fore. The sensibilities of environmentalists and even rock climbers and mountain climbers themselves are offended by piton-studded rock faces as well as a mountain studded with the protruding ends of old pitons, which in most cases have corroded and left rust or corrosion streaks on the surrounding rock. Such streaks are visible from a long distance and, as noted, offensive to almost everyone. The uncorroded pitons themselves are also clearly visible from closer up, however, and are objectionable from an aesthetic viewpoint to nearby observers, as well as even to "dyed in the wool" rock climbers, who prefer to start their climb on what at least appears to be a pristine, substantially untouched surface. As expressed sometimes by climbers, one might almost as well climb the side of a building as a "natural" rock face studded with protruding pitons and climbing chocks. Recreational mountain climbers have much the same feeling. The Matterhorn in Switzerland has, for example, been referred to as "the iron mountain" for decades as a result of the number of old pitons in this frequently climbed, but challenging, mountain.

At one time all pitons were either pounded into soft rock, into natural cracks or orifices, or into holes laboriously chiseled into the rock face with a hammer and chisel. In recent years, however, climbers have gone technological and have adopted battery pack electric drills to form orifices in a rock face for their pitons or chocks. This saves considerable time, but still results in a rock face studded with hardware. While some climbers have laboriously removed their used pitons, this takes additional time and effort and is practiced more in the breach than otherwise. Removal of the chock where practiced, however, also prevents its deterioration and possible later failure in the rock when used by a second climber.

The present inventors have determined that one of the difficulties in encouraging the removal of used pitons and the like is that there has not been available a suitable piton or chock for convenient insertion into or quick removal from drilled orifices in a rock face. Such drilled orifices are, in themselves, not greatly noticeable even from close up and from a distance are substantially invisible, so that they are much less objectionable than protruding pitons or the like. Furthermore, investigation by the inventors has shown that drilled orifices, which usually have fairly smooth walls, do not deteriorate greatly over long periods. This is particularly so if such orifices are angled slightly downwardly so they do not collect moisture, but instead remain clean and dry. Such orifices can be safely used again and again by subsequent climbers. The removable chocks and pitons available in the past have been designed, however, for use mostly in cracks and the like and are not efficient in drilled orifices. The present inventors have, therefore, developed a novel expansible head chock designed especially for use in drilled orifices in rock faces. Such expansible head chock has proved effective and efficient in drilled orifices and can be easily removed from and reinserted into such orifices. This saves the rock face and meets with the approval of both environmentalists and rock climbers as well as mountain climbers.

The present inventors' expansible safety chock incorporates an expansible head portion comprised of a plurality of, and preferably three, relatively movable wedge-shaped sections. Two of these sections are held longitudinally stationary with respect to each other and to the body of the chock and the third section, to which a climber's safety rope is attached via an attachment means such as a loop or the like slides longitudinally with respect to the other two sections. The relative movement of the three wedge configured sections with respect to each other results in an effective change in transverse diameter of the head portion which will effectively wedge the chock in a limited diameter cylindrical orifice when tension is placed upon a climber's safety rope. The three separate sections or plurality of sections of the head are designed with an open construction to minimize binding of the wedge sections against each other. Such binding could otherwise occur as a result of clogging, resulting from rock dust generated in the rock orifice by the rock drill by which the orifices are formed. The body portion of the chock, which is preferably a rigid body, when used in a substantially straight bored or drilled hole, will, upon the placement of significant weight on its safety line, tend to itself become wedged in the orifice, adding extra security to the belaying action of the safety chock. Preferably, the outer circumferences of the body portion is toothed or sharply corrugated to add to the security of the safety chock in the drilled orifice upon the application of weight to the end of the safety rope. The body portion of the chock is also preferably internally accessible to allow for cleaning or blowing out any rock dust derived from the drilling of the orifice in a rock face with the rock drill. The safety chock of the invention not only provides an extremely secure anchor for belaying of safety lines for rock climbing, but can be easily removed from the orifice when not in use to prevent aesthetic degradation of the rock face, plus easily reinserted into the same or other drilled orifices for subsequent further belaying of safety ropes. The expansible safety chocks are also very desirably provided commercially in packages of several mixed diameter safety chocks designed for use with a standardized size rock bit to obtain a fairly tight fit in the rock orifice, depending upon the accuracy of drilling and to some extent the frangibility of the rock underlying the drilled surface. A further understanding of the invention will be gained by review of the appended drawings in conjunction with the following description and disclosure.

Figure 1:
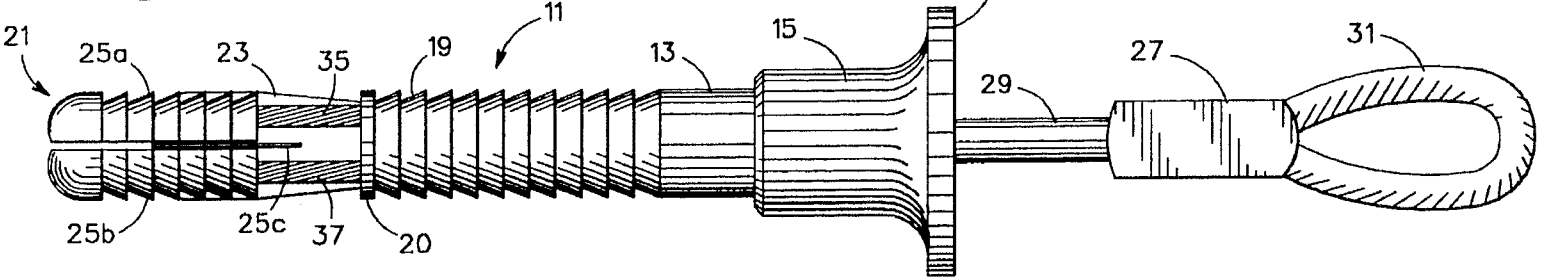
FIG. 1 is a plan view of an expansible head safety chock for installation particularly in bored or drilled orifices in rock walls.
Figure 5:
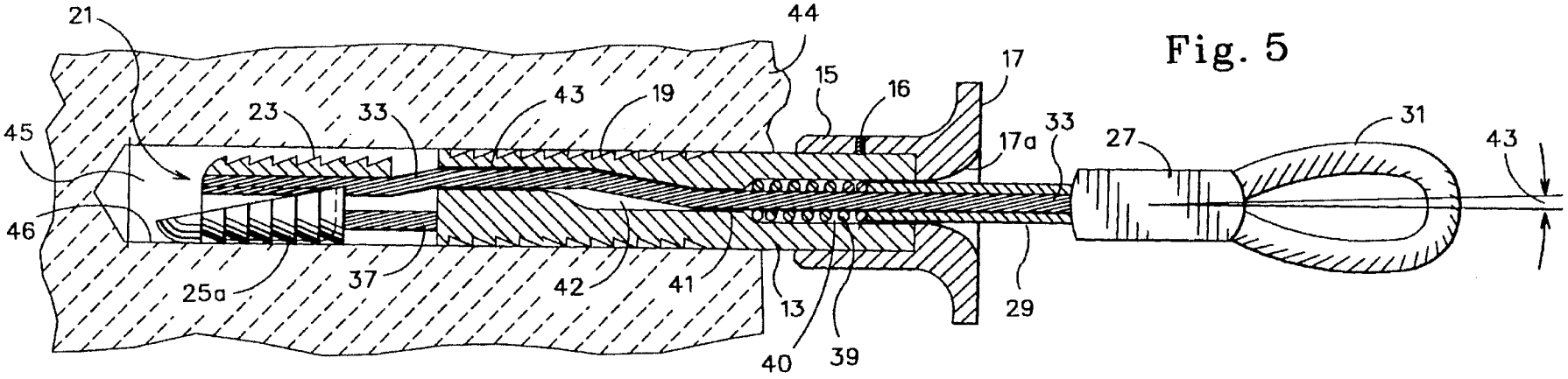
FIG. 5 is a partially broken away side view of the expansible safety chock of the invention as initially placed in a drilled orifice in a rock face.
Figure 6:
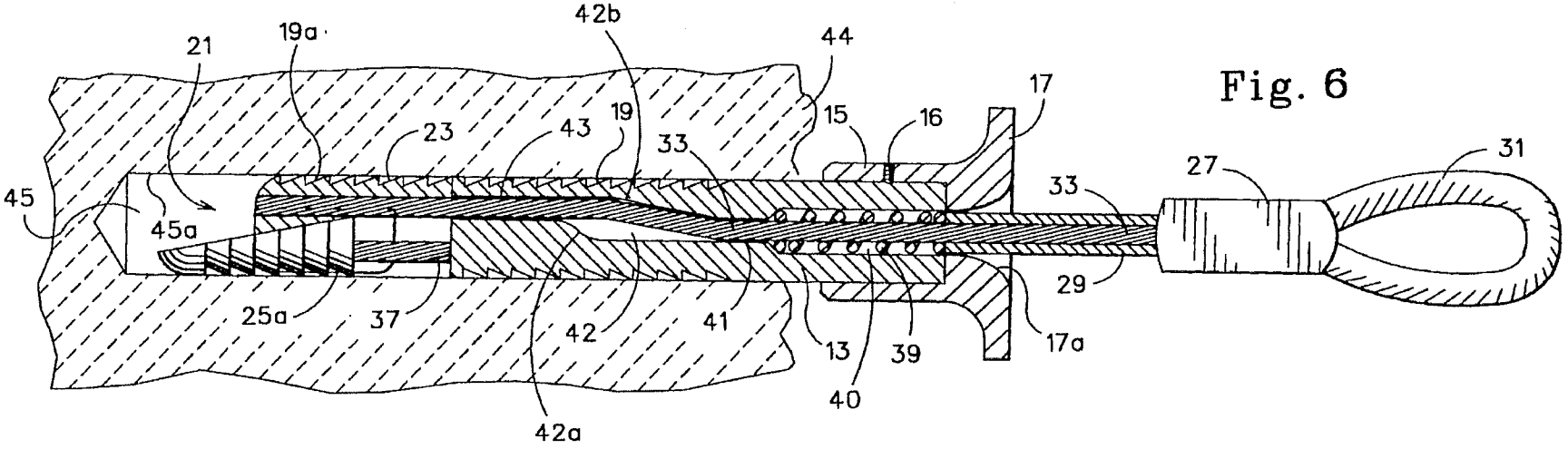
FIG. 6 is a partially broken away side view of the expansible safety chock of the invention after having been expanded ready to serve as a belaying point for a climbing rope.

FIG. 1 is a top or plan view of the expansible safety chock 11 of the invention. Such safety chock 11 comprises a body portion 13 having at or on the outer end a cap section 15, one end of which cap section is expanded into finger grippable flanges 17. Preferably the flanges 17 are provided with a circumferential concave radiused configuration on the outside, as shown in FIGS. 1, 5 and 6, plus a more or less matching convexly radiused configuration on the inside providing a radiused inner surface 17*a* over which wire cable may be suddenly bent without damage to such wire cable. See FIGS. 5 and 6. The inner end of the main body portion 11 is provided with a series of wedge-shaped teeth 19 extending over somewhat more than half the length of the body portion or, when the cap section 15 is taken into account, more than about three-quarters of the exposed length of the body portion 13. Such teeth 19 may be in the form of consecutive circumferential wedges as shown, but could take other forms such as uniformly inclined tooth sections or spiral teeth. The form of the teeth 19 shown in FIG. 1 are preferred because they, in effect, extend in the direction in which movement of the expansible chock during support of a climber is to be resisted. At the inner end of the body portion, there is also preferably a flange 20 which serves as an abutment between the inner end of the body portion 13 and the expansible section or head section 21 of the safety chock when the principal or largest wedge-shaped portion 23 of the expansible head 21 is brought inwardly toward the main body portion of the expansible chock. If the flange 20 was not present, the principal wedge-shaped portion of the expansible head section 21 might have a tendency to override the main body portion 13 by climbing up the incline of the end teeth 19. While this would be unlikely to have any serious effects, since the force exerted upon the principal wedge section 23 is only during exertion of a force upon the safety loop 31, hereafter described, in which case, overriding of the wedge section 23 over the teeth 19 on the main body portion 13 would only make the wedging of the safety chock 11 tighter in the drilled hole, it might, at least theoretically, place an off-center force upon the wire rope or cable which serves to attach the safety loop 31 of the safety chock to the wedge section 23.

The expansible head section 21 of the safety chock 11 of the invention is comprised preferably of three parts, although it could include additional parts. As shown in FIGS. 1, 2, 3 and 4, the three parts are a principal wedge-shaped portion 23 of the expansible head 21, plus a second dual or secondary troughed portion 25 comprised of two smaller wedge-shaped portions 25*a* and 25*b* of the overall expansible head-shaped portion 21. As shown, the wedge-shaped portion 23 of the expansible head portion 21 is abutted by and rides within the trough of the secondary portion of the expansible head. Such secondary portion is, as noted above, comprised of the two smaller wedge-configured sections 25*a* and 25*b*. There is set into a central portion of the inner face of the section 23 a further key 25*c* which extends outwardly between the two smaller wedge-shaped sections 25*a* and 25*b* to generally keep them aligned with the larger section 23, or more properly, perhaps, to keep the larger wedge section 23 aligned with the two smaller wedges 25*a* and 25*b* as it moves past them. The angle of the key 25*c* in the larger head section 23 provides together with the inner surfaces of the larger wedge section 23 on both sides of the key essentially triangular seating or guide openings 26*a* and 26*b* into which the smaller wedge-shaped portions 25*a* and 25*b* of the expansible head 21 fit. Such triangular seating openings serve as open guides or tracks for relative movement between the larger section 23 of the expansible head 21 and the two smaller sections 25*a* and 25*b*. The expansible head portion 23 is mounted on a large wire cable or strand section 33, shown more fully in FIGS. 5 and 6, which extends through the body portion 13 of the safety chock and through a protective sheath 29 into a cable clamp 27. The two smaller wedge-shaped expansible head sections 25*a* and 25*b* are mounted upon two short sections of wire cable or strand 35 and 37 which are swaged or soldered into the lower portion of the main body portion 13 of the safety chock of the invention. The construction of the head portion of the expansible chock of the invention is shown more clearly in FIG. 4 where the two small wedge-shaped sections 25*a* and 25*b* of the expansible head section 21 have been inclined outwardly by arbitrarily bending the short sections of wire strand or cable 35 and 37 to which they are attached from the normal disposition of such strand or cable sections in order to more clearly show the larger wedge-shaped section 23 behind them with the key 25*c* extending upwardly between the two smaller wedge-shaped sections 25*a* and 25*b*. Since the larger head section 23 of the multi-part expansible head 21 is attached to a cable 33 extending freely through the body 13 of the expansible chock of the invention, while the two smaller individual sections 25*a* and 25*b* are secured to cables 35 and 37 which are in turn attached directly to the body portion 13 of the expansible chock, the larger section 23 may slide past the smaller sections 25*a* and 25*b* when the strand 33 is moved relative to the body section 23.

Figure 3:
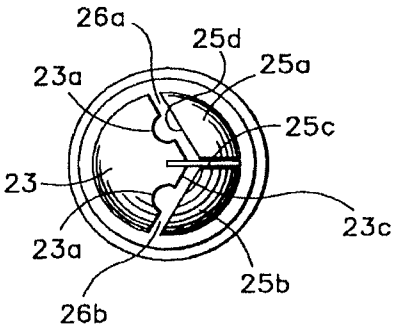
FIG. 3 is an end view of the expansible head portion of the safety chock of the invention shown in FIGS. 1 and 2.

The wedge shaped members 23 and 25*a* and 25*b* of the expansible head 21 have radii and consequently outer arcuate surfaces preferably at least approximately matching the radius and outer circumference of the body portion 13 and preferably also have longitudinally smooth inner surfaces 23*c* and 25*d*, as indicated in FIGS. 2 and 3, adapted for rectilinear passage past each other along their intercontacting surfaces to facilitates relative wedging movement of said wedge shaped members past each other. The wedge members consequently when moved into expanded positions will have the principal portions of their outer arcuate surfaces contacting the inner circumference of the drilled orifice in a rock face in which they are designed to be used.

Figure 4:
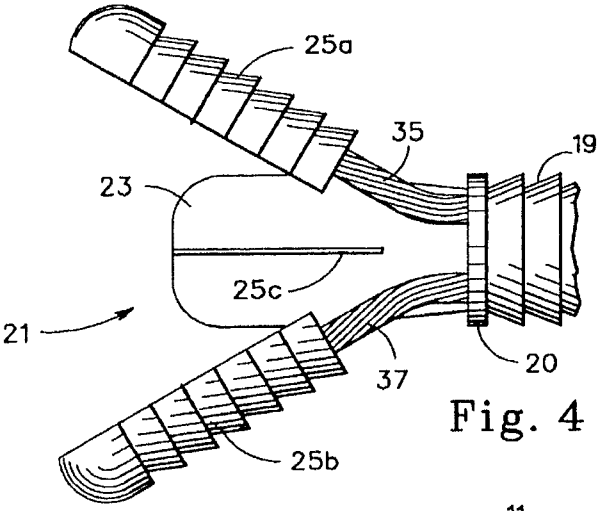
FIG. 4 is an enlarged plan view of the expansible head portion of the head of the safety chock of the invention with the two smaller expansible sections arbitrarily pulled to the side to illustrate the three-part construction of the head.

In FIG. 4, the larger wedge-shaped section is shown in expanded position or condition, as shown in FIG. 2, with its lower periphery in contact with the circular flange 20 on the bottom of the body portion 13. In such expanded condition, the cross-sectional dimensions or diameter along at least one cross-sectional dimension is greater than in a reduced or non-expanded condition. As shown, the teeth 19 on the main body portion 13 of the safety chock of the invention are continued onto the wedge-shaped sections 23 and 25*a* and 25*b* of the expansible head 21. This is convenient for manufacture, but the teeth could also vary from one section to another.

FIG. 5 shows the safety chock 11 of the invention placed in a drilled orifice or hole 45 in a rock face 44 with the expansible head section 21 near the lower or inner end of the orifice or hole 45 and with the main body portion 13 of the safety chock essentially filling the entire diameter of the opening 45. The expansible head section 21 is shown in FIG. 5 positioned so that the two sections of such head, namely 23 and 25, are positioned such that the overall diameter or cross-sectional dimensions of the head section 21 is reduced, though not necessarily to a minimum, and the teeth of one or both sections are not dug into the side of the drilled orifice. For example, in FIG. 5, the main wedge-shaped section 23 is disposed at a distance from the inner end of the body portion 13 of the safety chock 11 so that, due to the wedge-shaped section of the pieces forming the entire head, the section 23, including its teeth 19*a*, are removed from the wall of the rock orifice 45. This is the configuration in which the safety chock 11 is inserted into the drilled orifice 45 in preparation for expansion of the head to lock the safety chock into the drilled orifice 45. Retention of the principal head section 23 in this non-expanded configuration is accomplished by pressing on the top of the loop 31 of the wire rope or strand 33 to overcome the elastic force of biasing spring 39 to maintain the wedge-shaped head portions 23 and 25 in the position shown in FIG. 5.

Once the expansible head portion 21 on the main body portion 13 of the safety chock 11 is placed in the drilled hole 45, the pressure on the end of the loop 31, usually applied by pressing downwardly with the thumb of the climber's hand while looping two fingers of the same hand about the flanges 17 of the head cap 15 of the safety chock 11, is released. When such pressure of the thumb of the climber is released from the end of the loop 31 the spring 39 contained in an orifice 40 within the upper end of the main body portion 13 of the safety chock will exert pressure upon the end of a sliding sheath 29 surrounding the wire cable 33, forcing such sheath 29 outwardly together with the clamp 27 and consequently, placing the wire strand 33 under tension such that the wedge-shaped section 23 of the expansible head 21 is moved outwardly as shown in FIG. 6 so that the teeth 19*a* tend to bite into the side walls of the orifice 45. Movement of the wedge-shaped section 23 to contact the wall of the orifice also wedges the smaller wedge sections 25*a* and 25*b* into the side wall 45*a* of the drilled orifice 45, as shown in FIG. 6. This movement will effectively wedge the overall expansible head 21 into the walls of the orifice 45 and prevent extraction of the device from the orifice 45. If now a heavy force is placed upon the loop 31, such as by having the safety rope of a climber attached to such loop pulled by a falling body such as that of the climber, the tension on the strand 33 will be severely accentuated over the tension applied through the spring 39 and the teeth 19*a* of the sections 23 and 25 of the expansible head 21 will be even more severely forced into the walls of the orifice 45, rendering it impossible to remove the safety chock from the orifice.

As will be evident in FIGS. 5 and 6 when a downward tension is placed upon the loop 31, the cable 33 together with its sheath 29 will be downwardly bent over the inner convex radius 17*a* of the flanges 17 on the cap section 15. The radius 17*a* is formed with curvature over which the cable 33 may be suddenly bent without undue bending stress or notching of such cable. A fairly small radius is shown in FIG. 5 and 6. However, it will be understood that the internal radius 17*a* may in some cases provide essentially a bell mouthed arrangement in which the interior radius closely tracks the external radius of the flanges 17.

It will be evident from the Figures, and particularly FIG. 3, that the expansion of the overall dimensions of the expansible head 21 is in essentially three outward directions determined by the angles of the inner or mating surfaces of the separate expansible head pieces. Furthermore, when the separate head pieces 23, 25*a* and 25*b* are in expanded condition within an essentially very close fitting orifice in a rock face, the arcuate outside surfaces of the individual expansible sections will match and closely fit the inside dimensions of the orifice so the teeth on the expansible sections may obtain a circumferential grip upon or into the walls of said orifice. More than three separate expansible head sections may be provided upon the expansible chock, but it has been found that three sections are normally sufficient to obtain an excellent fit and bearing upon the orifice walls.

In addition to the wedging force exerted upon the wedge-shaped portions 23 and 25 by force applied via a safety rope passing through the loop 31, the force of any such weight, which is directed downwardly upon the loop, will tend to pull the loop downwardly, applying pressure or tension downwardly on the portion of the cable 33 extending beyond cap portion 15 of the expansible chock and tending, as a result, to slightly pivot the main body portion 13 of the safety chock within the orifice 45, thus bringing the teeth 19 upon the main body portion into accentuated contact with the outer portion of the side wall 45*a* of the orifice 45. Such pivoting tendency, therefore, also aids in wedging the body portion 13 in the orifice by tending to rotate or jam such body portion within the orifice, adding extra security to the safety chock so far as withdrawal from the orifice is concerned. When the drilled orifice 45 is very close fitting about the main body portion 13 of the safety chock, the biting of the teeth 19 of the main body portion of the safety chock into the walls of the rock orifice 45 will normally in itself be sufficient to prevent the safety chock from being withdrawn from the orifice so long as the preferred downward angle of the drilled hole is only a minimum number of degrees, say from 1 to 5 degrees, downwardly, to prevent the entrance of any significant moisture into the orifice. Furthermore, the wedging of the expansible head section 21 within the orifice 45 by the tension applied to the cable 33 through the loop 31 is sufficient to more than prevent the withdrawal of the safety chock from the orifice, even without any action from or even the presence of teeth 19 on the main body portion of the chock. Consequently, the provision of the expansible head 21 and the teeth 19 on the main body portion 13 of the safety chock provides double assurance of complete security of the safety chock within the orifice 45.

Since the safety chock of the invention is designed to be used within drilled orifices in a rock face, which orifices may frequently be freshly drilled, it is important that the construction of the expansible head of the safety chock have an open construction as shown. If, for example, the three sections of the expansible head of the safety chock of the invention were dovetailed together by some close fitting interengagement arrangement, fine rock dust derived from drilling the hole could well enter into the interengaging portions of the wedge-shaped sections and cause them to bind so that not only would it be difficult to force the wedge-shaped sections into the unexpanded position, but the spring 39 might encounter difficulty in forcing the unexpanded head section back into the expanded configuration, and even under the sudden exertion of an extreme force caused, for example, by a falling body exerting tension upon the loop 31, the resistance caused by such binding might be sufficient to prevent the two sections 23 and 25 of the safety chock from quickly moving into expanded configuration so as to immediately wedge the safety chock into the orifice 45 with no chance of it slipping out of the orifice. As will be readily seen by inspection of the drawings, such binding of the parts together is impossible in the arrangement developed by the present inventors, since the separate pieces can ride separately and freely over each other and can tolerate considerable deposited material between them, without any serious inhibition of their movement. To this end, also, it is preferred, but by no means necessary, for the main expansible head section 23 to be provided with one or more shallow grooves 23*a*, as seen more clearly in FIG. 3, which shallow grooves will tend to collect small deposits of dust and aid in preventing a major buildup between the surfaces of the wedge-shaped heads 23 and 25*a* and 25*b*, although, as pointed out above, the deposition of even a significant layer of rock dust or other detritus between the sections will not interfere with expansion of the wedge-shaped pieces by movement past each other under the imposition of either the resilient force of the spring 39 or a weight or momentum induced force exerted through the loop 31.

In addition to providing an open construction of the wedge-shaped members 23 and 25, the present inventors have provided that the cap 15, which is normally, as shown in FIGS. 5 and 6, maintained upon the main body portion 13 by a set screw 16 which provides sufficient wedging so that finger pressure upon the flanges 17 will allow the thumb of the same hand of the user to exert sufficient force upon the end of the loop 31 so that the wire cable 33 is forced inwardly and the wedge-shaped section 23 is forced away from the wall of the orifice 45 by being forced rearwardly along the shallower surface angle of the teeth 19*a*, as shown, rather than having the cap section 15 pulled outwardly away from the main body portion 13 of the safety chock. When it is desired to clean out the interior of the safety chock and particularly the spring chamber 40, as shown in FIG. 5, as well as the strand chamber 42, the cap 15 may be merely dismounted from the main body portion 13 to allow the chambers 40 and 42 to be either shaken out or blown out periodically. This also prevents any possible binding of the wire cable or spring within these chambers. It will be understood that in order to dismount the cap 15 completely from the main body portion 13 of the safety chock, the position of the clamp 27, which may in some instances be substituted for by a hot metal socket of the same general characteristics, may be varied. For example, the clamp 27 may be mounted upon or against the sheath 29 of the wire cable 33 at a greater distance from the flanges 17, allowing room for the head 15 to be completely removed from the main body portion 13. In an improved version of the apparatus, furthermore, shown in FIG. 7, the cap portion 15 may be mounted upon the body portion 13 by means of threads 18, to provide an even more secure interconnection between the cap portion 15 and the body portion 13 of the apparatus, but also to allow the cap portion 15 to be conveniently removed from the body portion 13 to gain access to the chambers 40 and 42 in order to either make sure such chambers are not being obstructed by rock dust or other detritus or to clean out such chambers. During such cleaning out, it will be understood, the spring 39 is desirably removed from the chamber 40 to allow easier cleaning of any detritus within the chamber. In FIG. 7, the preferred bell mouthed or lesser radiused configuration 17*a* of the end of the cap 17 is not shown and the cable 33 is shown passing from a straight sided orifice. However, it will be understood that the concavely radiused arrangement shown in FIGS. 5 and 6 or an equivalent radius arrangement is preferred to prevent any damage to the cable 33 in case of a fall of a climberr using the safety chock.

It should be noted in FIGS. 5 and 6 also that all interior machined surfaces over or against which the cable 33 passes will be smooth and with radiused edges, for example, at the radiuses 42*a* and 42*b*, to facilitate ready movement of the cable 33 past such sections and to avoid any possibility of stress notches being pressed into the surface of the cable. It will be noted in FIG. 5 in this regard that the cable 33 exiting from the body portion 13 is shown with a downward bend with the wedge-shaped section displaced substantially from the wall 45*a* of the drilled orifice 45. Such relative wide spacing, however, is merely illustrative and wedge-shaped section 23 will usually remain rather closely spaced to the wall of the orifice even in the unexpanded configuration of the expandable head 21 due to the resilience of the cable 33.

In FIG. 8, there is shown an improved clamp or hot metal socket 27*a* for securing of the loop 31 of the wire strand 33 or providing an orifice through which the safety rope may be passed. The clamp or hot metal socket 27*a* is formed with a flaring configuration and an indented outer surface 27*b* which is more convenient for the placement of the thumb of the user upon to apply force through the cable 33 to move the wedge-shaped expansible section 23 with respect to the two adjoining sections 25*a* and 25*b*. It will be understood in both the embodiments shown in FIG. 8 and the previous embodiments, that the sheath 29 upon the strand 33 and extending between the clamp or hot metal socket 27 and the chamber 40 will be formed from a flexible but strong plastic or other material upon which sufficient force may be placed to force the sheath 29 outwardly by the spring pressure derived from the spring 39 upon its lower surface and still allow the rope to bend in the section between the flanges 17 and the lower portion of the clamp 27 or 27*a* when an extreme force is placed upon the safety chock by application of a heavy weight at the end of the loop 31. If the sheath 29 were made or formed, for example, from a metal material, it would be quite operable or useable so long as the cable 33 did not have tension exerted on it, but after a fall, the sheath 29 would, in most cases, be bent to such an extent that it could no longer be passed through the opening in the cap 15, rendering the entire chock unusable until a new sheath was provided. If desired, in fact, advantage of this relationship may be taken to assure that the safety chock will be inspected after a fall in connection with removal of sheath 29 and the insertion of a new straightened sheath so that the safety chock can continue to be used. This, however, is not usually desirable, since bending of the sheath 29 might prevent the rope 33 from being forced inwardly to release the teeth 19*a* on the main expansible section 23 so that the entire chock may be removed from the hole or orifice in the rock face after it has been used to support a body in a safety situation.

It has been found to be convenient to supply the safety chock of the invention with several slightly differing diameters of the main body portion so that a tight fit will be obtained in any given orifice drilled with a rock drill of a specific diameter. For example, several sets of safety chocks may be provided just 1/16th to 1/8th of an inch different in diameter to allow for a tight fit in an orifice either accurately or unevenly drilled. Such different diameter chocks are conveniently supplied in a package separating the chocks for convenience. Such package, furthermore, may also include a rock drill bit of the recommended size to be used with those particular chocks in order to make sure that a tight fit will be made with the rock wall of the drilled orifice. In this manner, it is assured that the user of the safety chock of the invention will be supplied with the sizes of equipment for the most efficient use of the chock of the invention. Such a package is shown in FIG. 9. In the embodiment shown in FIG. 9, three different sized chocks (the size differences of which are not detectable in the small scale shown in FIG. 9) are shown, namely safety chock 11, which may be the smallest size, safety chock 11*a*, which may be an intermediate size, and safety chock 11*b*, which may be the largest size. Also supplied in the same package as shown is a drill bit 46 which will normally be exactly the same in diameter as the safety chock 11. All these are preferably supplied in a single package designated as "P" with preferably separate compartments P1, P2, P3 and P4 for the various safety chocks and drill bit or bits. The bottom PB of the package "P" may be formed from cardboard or heavy plastic material and the top may be shrink wrap plastic P5, which, as shown, will be transparent in most cases so that the customer can see what he or she is purchasing. Advertising and other written material such as instructions and the like may be provided upon the cardboard or plastic backing. As will be understood, other configurations and designs of packaging may be used, but the basic concept of having a series of very closely dimensioned diameters of safety chock to allow for different sizes of ultimate holes which may be drilled by the drill 46 will be maintained and the drill is most preferably also provided in the same package to make certain the diameters conform. Of course, if an orifice is already in the rock face, a size of safety chock will be selected to best fill the diameter of the existing hole. In some cases, the climber may not have the best size of safety chock and in such cases, provided the hole is small enough so that there is sufficient wedging action by the expansible head 21, the hole may still be used with complete safety, assuming the rock is not unduly friable or frangible or otherwise deteriorated, or alternatively, of course, a new hole may be drilled with a rock bit dimensioned to exactly fit the safety chocks which are available to the climber.

As will be understood from the above description and discussions, by the use of the present invention, climbers are enabled to belay themselves upon rock faces without defacing such rock face by the mechanical devices for holding safety ropes or by corrosion stains and products caused by corrosion of pitons and rock bolts mounted on the rock face and left in position either for later use or simply because they are too difficult to extract from the orifice into which they have been forced. Furthermore, because of the construction of the safety chock of the invention, a more secure belaying or safety securing of climbers may be attained. Long term deterioration of the climbing aid with possible later failure when used by a later climber is also avoided.

Not only is a convenient and effective method of preventing desecration of rock walls by visible climbing devices and corrosion from such devices prevented by the use of the present inventors' system of safety rock chocks, but a more secure embedment of the safety chock in an orifice within the rock face is provided than has heretofore been available. It will be noted that by use of the apparatus of the invention in the approved manner a number of advantages are obtained which are pointed out in the foregoing description.

In the use of the apparatus of the present invention to fulfill the necessity to secure a protective safety chock into a rock face, if a hole or orifice is already situated in such rock face, such hole will be initially measured and then a safety chock having an approximate diameter of such hole will be placed in the orifice. Such safety chock will be forced into the orifice, preferably until the bottom portion of the head 15 abuts with the rock face or the chock otherwise binds in the orifice through the wedge-shaped portions at the bottom contacting the bottom of the hole. Such insertion will be made while the top of the loop 31 is compressed, usually by the thumb of the hand of the climber, while the fingers of the same hand of the climber engage the flange 17 of the head 15 of the safety chock apparatus 11. Once the apparatus of the invention is inserted into the orifice, the pressure upon the loop, either directly or through an intermediate structure, is released so that the spring 39 pushing upon the sheath 29 places tension upon the cable or strand 33 towards the outer end of the orifice, causing the wedge-shaped portion 23 of the expansible head 21 to be moved upwardly along the inclined portions of the wedge-shaped portions 25*a* and 25*b* until the teeth 19*a* of the head portion 21 are tightly engaged with the side walls 45*a* of the drilled rock orifice 45. The safety chock of the invention at this point is engaged within the orifice. The chock then remains in the orifice until its presence is no longer necessary for belaying the climber for safety reasons. At such point, the climber will again grasp the flanges 17 of the head portion of the apparatus and placing pressure, either directly or through intermediate structures upon the top of the loop 31, or to the rope 33, through the intermediate clamp 27, will cause the strand 33 to move inwardly moving the wedge-shaped head 23 toward the rear of the orifice 45, disengaging the teeth 19*a* from the walls of the orifice. At this point, the entire apparatus may be removed from the orifice 45 and reused in a second orifice.

If, on the other hand, there is no orifice already in the rock face, the climber will drill a suitable orifice, preferably by a rotary, battery-operated drill using a drill bit of a known diameter and when such orifice has been made, will select a safety chock in accordance with the invention of a closely similar diameter, or as closely as can be effected with the selection of safety chocks available and, following the same procedure as outlined above, will embed such safety chock within the orifice until its use is no longer required and then will remove it from the orifice by the same procedure as indicated above. By following such procedure, the very desirable result is obtained of being able to lock into an orifice of uniform size drilled into the rock face with safety chocks having a similar diameter which ensures double safety if an extreme weight is suddenly placed upon the chock member. In addition, no significant defacement of the rock surface occurs and the objections of environmentalists and rock climbers themselves to leaving or abandoning multiple climbing aids in rock faces is effectively overcome. Long term deterioration of the chock itself by corrosion and other weathering processes is also avoided with beneficial safety enhancement.

While the present invention has been described at some length and with some particularity with respect to several described embodiments, it is not intended that it should be limited to any such particulars or embodiments or any particular embodiment, but is to be construed with reference to the appended claims so as to provide the broadest possible interpretation of such claims in view of the prior art and, therefore, to effectively encompass the intended scope of the invention.

We claim:

1. A climbing aid for providing a removable anchor in an orifice pre-prepared in a rock face for receipt of such climbing aid comprising:

(a) a hollow elongated body member having a substantially uniform diameter and adapted for containment within a uniformly prepared elongated opening in a rock face extending substantially perpendicular with respect to the rock face into which the climbing aid is to be inserted, (b) an opening extending from one end of such hollow elongated body member to the other, (c) a wedge action-type expansible head disposed at one end of the hollow body member, said wedge action-type expandable head having an unexpanded diameter substantially equal to or less than the diameter of the hollow body member and an expanded diameter substantially greater than the diameter of the hollow body member said expansible head being comprised of at least three wedge members in which each of said wedge members has outer arcuate toothed surfaces the radius of each of which arcuate surfaces is substantially equal to the radius of the hollow body member, (i) a principal one of said wedge members having an outer arcuate surface greater in circumference than the outer arcuate surfaces of each of two secondary wedge members, but lesser in circumference than the outer circumference of the two secondary wedge members combined, (ii) the principal wedge member having a guiding key extending from a keyway on its inside surface and adapted to extend between the two secondary wedge members and a longitudinally smooth inside surface slanted outwardly toward the hollow body member, (iii) the two secondary wedge members having longitudinally smooth inner surfaces slanted inwardly toward an inner end of the hollow body member, each being arranged and adapted to fit into the space on each side of the guiding key defined by the key and the inner surface of the principal wedge member, (d) an outwardly curved portion at one end of the said hollow body member arranged and adapted for controlled grasping by the hand of a user of the climbing aid, (e) a principal cable means extending through the opening in the hollow body member and adapted at one end for attachment to climbing safety means and secured at the opposite end to the principal wedge member, (f) a pair of secondary cable means each attached at one end to the end of the hollow body member removed from the outwardly curved portion upon said hollow body member and at their opposite end to the secondary wedge members, (g) said secondary wedge members being arranged and adapted to form when longitudinally oriented with said principal wedge members an outer circumference adapted to pass into the prepared opening in the rock face, (h) the principal and secondary wedge members having inner mutually contacting angled surfaces adapted for rectilinear movement of said surfaces past each other such that relative movement of the principal wedge member along the intercontacting surfaces of the secondary wedging members causes an overall expansion of an outer cross-sectional dimension of the combined first and second wedging head means in one direction and overall contraction of said outer cross-sectional dimension in the opposite direction, and (i) resilient means to bias the principal and secondary wedge member in relative directions to generally expand the cross-sectioned dimension of the wedge-action type expansible head.

2. A climbing aid in accordance with claim 1 wherein the guiding key comprises an outwardly extending flat separator which extends between and guides movement of the principal wedge member along the secondary wedge members.

3. A climbing aid in accordance with claim 2 wherein the resilient means to bias the wedge members toward an expanded overall diameter comprises a resilient means within the hollow body member.

4. A rock climbing aid in accordance with claim 3 wherein the resilient means comprises a coil spring means surrounding the principal cable means.

5. A climbing aid in accordance with claim 4 wherein the end of the principal cable means extending from the hollow body member is formed into a loop secured by a fitting.

6. A climbing aid in accordance with claim 5 wherein a sheath upon the principal cable extending from the fitting into the hollow body member contacts the coil spring means to bias the cable outwardly.

7. A climbing aid in accordance with claim 6 wherein the loop of the principal cable means passes about a yoke which is in contact through intermediate tubular means with one end the coil spring means.

8. A rock climbing aid in accordance with claim 7 wherein the yoke has a concavely configured outer upper section adapted for exertion of force upon such section by the hand of the user.

9. A climbing aid in accordance with claim 1 wherein the hollow body member is formed of a rigid material and has teeth formed on the outer surface of the inner end.

10. A climbing aid in accordance with claim 9 wherein the teeth on the outer surface of the hollow body member are continuations of teeth on the outer circumference of the wedge-type expandable head.

11. A climbing aid in accordance with claim 1 wherein the outwardly curved portion at the end of the hollow body member is in the form of a curved flange formed on a separate cap section secured to the hollow body member.

12. A climbing aid in accordance with claim 11 wherein the cap section is removably secured to the hollow body member to allow removal for inspection and cleaning of the interior of the hollow body member.

13. A climbing aid in accordance with claim 2 additionally comprising:

(i) a flange on the inner end of the hollow body member adapted to prevent the wedge sections of the expansible head from overriding a toothed surface of the hollow body member.

14. A climbing aid in accordance with claim 13 wherein the outwardly curved portion at one end of the hollow body member is curved on both its surfaces and is circumferentially continuous about the opening in one end of said hollow body member and the interior of said hollow body member is smooth and radiused in any portions in contact with the principal cable means.

* * * * *